US006056632A

United States Patent [19]

Mitchel et al.

[11] Patent Number: 6,056,632

[45] Date of Patent: May 2, 2000

[54] SEMICONDUCTOR WAFER POLISHING APPARATUS WITH A VARIABLE POLISHING FORCE WAFER CARRIER HEAD

[75] Inventors: Fred E. Mitchel, Phoenix, Ariz.; John A. Adams, Escondido, Calif.; Thomas Frederick A. Bibby, Gilbert, Ariz.

[73] Assignee: SpeedFam-IPEC Corp., Chandler, Ariz.

[21] Appl. No.: 09/169,333

[22] Filed: Oct. 9, 1998

Related U.S. Application Data

[63] Continuation-in-part of application No. 08/800,941, Feb. 13, 1997, Pat. No. 5,851,140.

[51] Int. Cl.[7] ..... B24B 7/22

[52] U.S. Cl. ..... 451/288; 451/286; 451/289; 451/388

[58] Field of Search ..... 451/288, 287, 451/289, 286, 388, 398, 41

[56] References Cited

U.S. PATENT DOCUMENTS

| | | | |
|---|---|---|---|
| 3,449,870 | 6/1969 | Jensen | 51/216 |
| 3,841,031 | 10/1974 | Walsh | 51/283 |
| 3,857,123 | 12/1974 | Walsh | 51/131 |
| 4,132,037 | 1/1979 | Bonora | 51/131 |
| 4,239,567 | 12/1980 | Winings | 156/154 |
| 4,270,316 | 6/1981 | Mer et al. | 51/283 |
| 4,313,284 | 2/1982 | Walsh | 51/131.4 |
| 4,508,161 | 4/1985 | Holden | 165/1 |
| 4,671,145 | 6/1987 | Fehrenbach | 81/1 |
| 4,918,869 | 4/1990 | Kitta | 51/131.1 |
| 5,029,418 | 7/1991 | Bull | 51/281 |
| 5,036,630 | 8/1991 | Kaanta | 51/283 |
| 5,081,795 | 1/1992 | Tanaka | 51/131.1 |
| 5,193,316 | 3/1993 | Olmstead | 51/281 |
| 5,205,082 | 4/1993 | Shendon et al. | 51/283 |
| 5,230,184 | 7/1993 | Bukhman | 51/109 |
| 5,398,459 | 3/1995 | Okumura et al. | 451/41 |
| 5,423,558 | 6/1995 | Koeth et al. | 279/3 |
| 5,423,716 | 6/1995 | Strasbaugh | 451/289 |
| 5,449,316 | 9/1995 | Strasbaugh | 451/289 |
| 5,527,209 | 6/1996 | Volodarsky et al. | 451/388 |
| 5,564,965 | 10/1996 | Tanaka et al. | 451/287 |
| 5,584,746 | 12/1996 | Tanaka et al. | 451/41 |
| 5,584,751 | 12/1996 | Kobayashi | 451/285 |
| 5,605,488 | 2/1997 | Ohashi et al. | 451/7 |
| 5,624,299 | 4/1997 | Shendon | 451/285 |
| 5,660,517 | 8/1997 | Thompson et al. | 414/217 |
| 5,681,215 | 10/1997 | Sherwood et al. | 279/3 |
| 5,738,574 | 4/1998 | Tolles et al. | 451/288 |
| 5,762,539 | 6/1998 | Nakashiba et al. | 451/41 |
| 5,762,544 | 6/1998 | Zuniga et al. | 451/285 |
| 5,762,546 | 6/1998 | James et al. | 451/505 |
| 5,795,215 | 8/1998 | Guthrie et al. | 451/41 |
| 5,820,448 | 10/1998 | Shamouillian et al. | 451/287 |
| 5,899,800 | 5/1999 | Shendon | 451/287 |

*Primary Examiner*—Robert A. Rose
*Attorney, Agent, or Firm*—Quarles & Brady LLP

[57] ABSTRACT

A carrier head for a semiconductor wafer polishing apparatus includes a rigid plate which has a major surface with a plurality of open fluid channels. A flexible wafer carrier membrane has a perforated wafer contact section for contacting the semiconductor wafer, and a bellows extending around the wafer contact section. A retaining member is secured to the rigid plate with a flange on the bellows sandwiched between the plate's major surface and the retaining ring, thereby defining a cavity between the wafer carrier membrane and the rigid plate. A fluid conduit is coupled to the rigid plate allowing a source of vacuum and a source of pressurized fluid alternately to be connected to the cavity. An additional wafer carrier membrane is internally located with respect to the cavity formed by the wafer carrier membrane, and forms another cavity with respect to the rigid plate. Another fluid conduit is connected to the internal wafer carrier membrane's cavity, which is selectively pressurized to make the internal wafer carrier membrane contact the wafer contact section.

23 Claims, 5 Drawing Sheets

SEMICONDUCTOR WAFER POLISHING APPARATUS WITH A VARIABLE POLISHING FORCE WAFER CARRIER HEAD

CROSS-REFERENCE TO RELATED APPLICATIONS

This is a continuation-in-part of application Ser. No. 08/800,941, filed Feb. 13, 1997, now U.S. Pat. No. 5,851, 140 and which is incorporated herein by reference.

STATEMENT REGARDING FEDERALLY SPONSORED RESEARCH OR DEVELOPMENT

Not applicable.

BACKGROUND OF THE INVENTION

The present invention relates to semiconductor processing equipment, and more particularly to carriers for holding a semiconductor wafer during chemical-mechanical planarization.

Semiconductor wafers are polished to achieve a smooth, flat finish before performing subsequent process steps that create electrical circuit layers on the wafer. Many systems in the prior art accomplish polishing by securing the wafer to a carrier, rotating the carrier and placing a rotating polishing pad in contact with the rotating wafer. The art is replete with various types of wafer carriers for use during this polishing operation. A common type of carrier is securely attached to a shaft which is rotated by a motor. A wet polishing slurry, usually comprising a polishing abrasive suspended in a liquid, is applied to the polishing pad. A downward polishing pressure was applied between the rotating wafer and the rotating polishing pad during the polishing operation. This system required that the wafer carrier and polishing pad be aligned perfectly parallel in order to properly polish the semiconductor wafer surface.

The wafer carrier typically was a hard, flat plate which did not conform to the surface of the wafer which is opposite to the surface being polished. As a consequence, the carrier plate was not capable of applying a uniform polish pressure across the entire area of the wafer, especially at the edge of the wafer. In an attempt to overcome this problem, the hard carrier plate often was covered by a softer carrier film. The purpose of the film was to transmit uniform pressure to the back surface of the wafer to aid in uniform polishing. In addition to compensating for surface irregularities between the carrier plate and the back wafer surface, the film also was supposed to accommodate minor contaminants on the backside of the wafer surface. Such contaminants could produce high pressure areas in the absence of such a carrier film. Unfortunately, the films were only partially effective with limited flexibility and tended to take a "set" after repeated usage. In particular, the set appeared to be worse at the edges of the semiconductor wafer.

Another adverse effect in using conventional apparatus to polish semiconductor wafers was greater abrasion in an annular region adjacent to the edge of the semiconductor wafer. This edge effect resulted from two main factors, assuming a uniform polishing velocity over the wafer surface, (1) pressure variation (from the nominal polish pressure) close to the edge area and (2) interaction between the polish pad and the edge of the semiconductor wafer.

This latter factor was due to the carrier pressure pushing the wafer into the polishing pad. Thus, the polishing pad was compressed beneath the wafer and expanded to its normal thickness elsewhere. The leading edge of the wafer was required to push the polishing pad downward as it rode over new sections of the pad. As a consequence, an outer annular region of each wafer was more heavily worn away and could not be used for electronic circuit fabrication. It is desirable to be able to utilize the entire area of the wafer for electronic circuit fabrication.

Yet another problem with using conventional apparatus to polish semiconductor wafers was slower removal rates of material in the vicinity of the wafer's center (an effect referred to by some in the art as "center slow"). More specifically, when removing thin film layers, such as oxide film layers, from the wafer, the resulting oxide thickness was greater near the center of the wafer, as opposed to the more peripheral areas of the wafer. The post Chemical Mechanical Polishing (CMP) oxide pattern on the wafer surface typically resembled a dome-like shape with the thickest portion of the oxide located near the center of the wafer. Therefore, there existed a need to provide an improved semiconductor wafer polishing apparatus including a wafer carrier head design that corrects the center slow problem, as well as the additional shortcomings noted above.

BRIEF SUMMARY OF THE INVENTION

A general object of the present invention is to provide an improved wafer carrier head for polishing semiconductor wafers.

Another object is to provide a carrier head which applies uniform pressure over the entire area of the semiconductor wafer.

A further object of the present invention is to provide a surface on the carrier which contacts the back surface of the semiconductor wafer and conforms to any irregularities of that back surface. Preferably, the surface of the carrier plate should conform to even minute irregularities in the back surface of the semiconductor wafer.

Yet another object is to provide a carrier plate which eliminates the greater erosion adjacent to the semiconductor wafer edge as produced by previous carriers.

Still another object of the present invention is to provide a carrier head which applies non-uniform, yet controlled pressure over the area of the semiconductor wafer to correct center slow or other troublesome removal patterns.

These and other objectives are satisfied by a carrier head, for a semiconductor wafer polishing apparatus, which includes a rigid plate having a major surface. A wafer carrier membrane of soft, flexible material has a wafer contact section for contacting the semiconductor wafer. The wafer carrier membrane is connected to the rigid plate and extends across at least a portion of the major surface defining a first cavity therebetween. A retaining member is secured to the rigid plate around the wafer contact section of the wafer carrier membrane. A first fluid conduit enables a source of pressurized fluid to be connected to the first cavity. The term, "pressurized," as used hereinafter, is intended to mean pressurizing a fluid to any desired positive pressure or providing a vacuum. An internal wafer carrier membrane is also provided, and is also preferably made of a soft, flexible material. The internal wafer carrier membrane includes a section for contacting the back or inner surface of the wafer carrier membrane's wafer contact section, and the internal wafer carrier membrane is connected to the rigid plate and extends across at least a portion of the major surface, thereby defining a second cavity therebetween. A second fluid conduit is provided by which a source of pressurized fluid is connected to the second cavity.

In the preferred embodiment of the present invention, the major surface of the plate has a plurality of open channels which aid the flow of fluid between the plate and the membranes. For example, the major surface may have a plurality of concentric annular channels interconnected by a plurality of radially extending channels.

The preferred embodiment of the wafer carrier membrane has the wafer contact section connected at its edge by a bellows from which a flange outwardly extends. The flange is sandwiched between the major surface and the retaining member to form the cavity. The preferred embodiment of the internal wafer carrier membrane comprises a membrane including a central section for contacting the back or inner surface of the wafer carrier membrane's wafer contact section, a bellows connected at its edge to the central section, and a flange connected to and outwardly extending from the bellows wherein the flange is sandwiched between the major surface and a locking member to form the second cavity therebetween. Alternative embodiments of the internal wafer carrier membrane include: 1) a simple membrane including a central section for contacting the back of the wafer contact section of the wafer carrier membrane, a sloped section coupled to and extending upwardly from the central section, and an outer section coupled to the sloped section and which is sealably connected around the perimeter thereof to the rigid plate to form a cavity therebetween; and 2) a balloon-like membrane including a central section for contacting the back of the wafer contact section of the wafer carrier membrane.

During polishing, the cavity is pressurized with fluid which causes the wafer contact section of the wafer carrier membrane to exert force against the semiconductor wafer pushing the wafer into an adjacent polishing pad. Because the wafer carrier membrane is very thin, soft and highly flexible, it conforms to the back surface of the semiconductor wafer which is opposite to the surface to be polished. By conforming to even minute variations in the wafer surface, this reduces point pressures caused by defects in the wafer surface, thereby producing uniform polishing. By applying an appropriate pressure, using any one of the internal wafer carrier membrane embodiments, to the back of the wafer contact section of the wafer carrier membrane, the localized pressure in the vicinity of the wafer center may be increased, thereby alleviating the center slow problem.

A lower edge of the retaining member contacts the polishing pad and is substantially co-planar with the semiconductor wafer surface being polished. This co-planar relationship and the very small gap between the inner diameter of the retaining member and the outer diameter of the semiconductor wafer significantly minimizes the edge abrasive effect encountered with prior polishing techniques. The retaining member pre-compresses the polishing pad before reaching the edge of the semiconductor wafer. With only a very small gap between the retaining member and the edge of the semiconductor wafer, the polishing pad does not expand appreciably in that gap so as to produce the edge abrasive effect previously encountered.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefor, to the claims herein for interpreting the scope of the invention.

DESCRIPTION OF THE INVENTION

Figure 1:
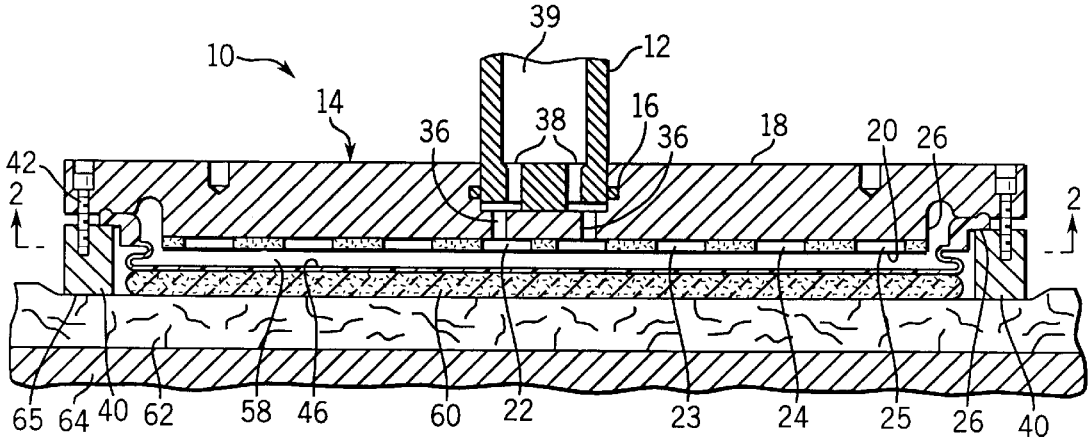
FIG. 1 is a diametric cross-sectional view through a wafer carrier.

Referring now to the drawings, wherein like reference characters represent corresponding elements throughout the several views, and more specifically referring to FIG. 1, a semiconductor wafer polishing apparatus has a carrier head 10 mounted on a spindle shaft 12 that is connected to a rotational drive mechanism by a gimbal assembly (not shown). The end of the spindle shaft 12 is fixedly attached to a rigid carrier plate 14 with a flexible sealing ring 16 therebetween to prevent fluid from leaking between the spindle shaft 12 and the carrier plate 14. The carrier plate 14 has a planar upper surface 18 and a parallel lower surface 20.

Figure 2:
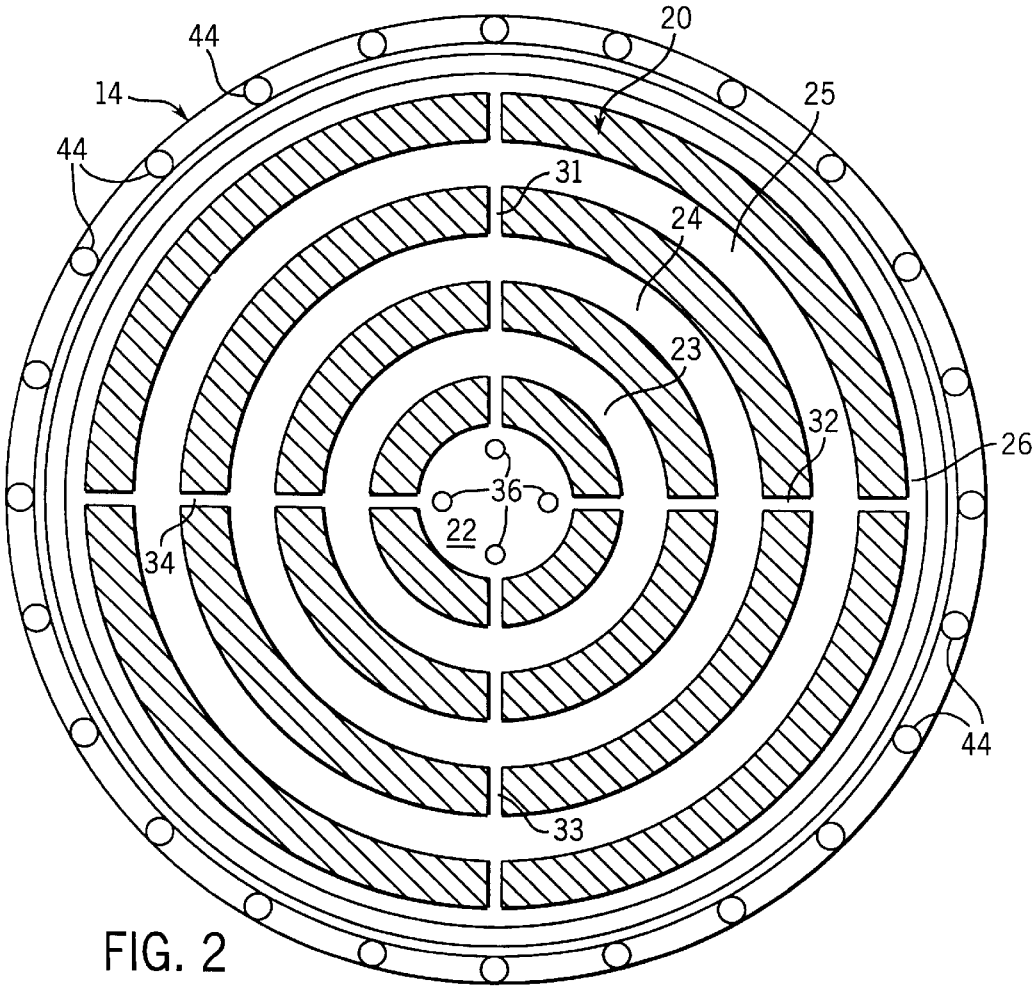
FIG. 2 is a bottom plan view of the rigid plate.

The lower surface 20 of the carrier plate 14 has a plurality of grooves therein as shown in FIG. 2. Specifically, the lower surface 20 has a central recessed area 22 with three spaced apart concentric annular grooves 23, 24 and 25 in order of increasing diameter. An annular recess 26 extends around the peripheral edge of the lower surface 20. Four axial grooves 31, 32, 33 and 34 extend at ninety degree intervals from the central recess 22 to the annular recess 26 through each of the concentric annular grooves 23, 24 and 25. Thus, each of the annular grooves 23–25, central recess 22, and peripheral recess 26 communicate with each other through the axial grooves 31–34.

Four apertures 36 extend from the central recess 22 through the carrier plate 14 to a recess on the upper surface 18 in which the spindle shaft 12 is received, as seen in FIG. 1. Apertures 36 communicate with apertures 38 through the end of the spindle shaft 12, thereby providing a passage from a central bore 39 of the spindle shaft 12 to the underside of the carrier plate 14.

A retaining ring 40 is attached to the lower surface 20 of the carrier plate 14 at the peripheral recess 26. The retaining ring 40 is secured by a plurality of cap screws 42 which are received within apertures 44 that open into the peripheral recess 26 of the carrier plate 14. A circular wafer carrier membrane 46 is held between the carrier plate 14 and the retaining ring 40 stretching across the lower surface 20 of the carrier plate 14 to form a flexible diaphragm beneath carrier plate 14. The circular wafer carrier membrane 46 preferably is formed of molded polyurethane, although a thin sheet of any of several soft, resilient materials may be utilized. Moreover, the circular wafer carrier membrane 46 may be made from several soft, resilient sheets of material connected into a single sheet.

Figure 3:
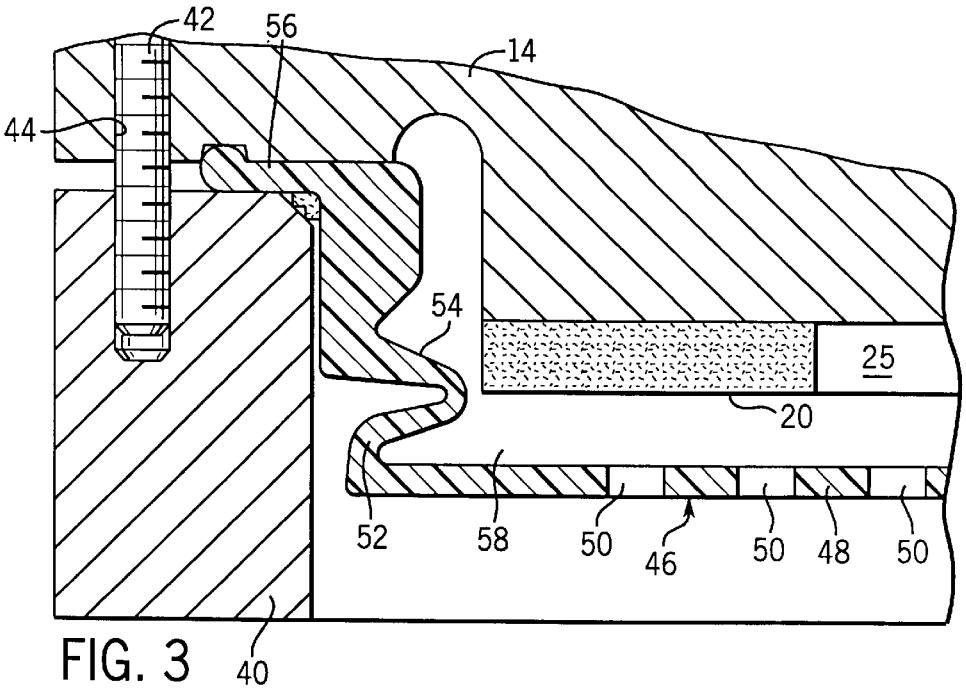
FIG. 3 is an enlarged cross-sectional view of a section of FIG. 1 showing details of the flexible wafer carrier membrane.

Referring in addition to FIG. 3, the flexible circular wafer carrier membrane 46 has a relatively planar, circular wafer contact section 48 with a plurality of apertures 50 extending therethrough. The circular wafer contact section 48 is between 0.5 and 3.0 millimeters thick, for example 1.0 millimeter thick. The circular wafer contact section 48 is bounded by an annular rim 52 which has a bellows portion 54 to allow variation in the spacing between the bottom surface 20 of the carrier plate 14 and the back of the wafer contact section 48 of the membrane 46. The opposite edge of the annular rim 52 from the wafer contact section 48 has an outwardly extending flange 56 which is squeezed between the peripheral recess surface of the carrier plate 14 and the retaining ring 40 due to the force exerted by the cap screws 42.

In order to process a semiconductor wafer, the carrier head 10 is moved over a wafer storage area and lowered onto a semiconductor wafer 60. The spindle shaft 12 is connected to a vacuum source by a rotational coupling and valve (not shown). With the carrier head positioned over the semiconductor wafer 60, the vacuum valve is opened to evacuate the cavity 58 formed between the carrier plate 14 and the wafer carrier membrane 46. This action draws air into cavity 58 through the small holes 50 in the wafer carrier membrane 46 and creates suction which draws the semiconductor wafer 60 against the wafer carrier membrane 46. Although evacuation of chamber 58 causes the membrane 46 to be drawn against the lower surface 20 of the carrier plate 14, the pattern of grooves 23–34 in that surface provides passageways for air to continue to be drawn through the holes 50 in the membrane 46, thereby holding the semiconductor wafer 60 against the carrier head 10. It should be noted that the interior diameter of the retaining ring 40 is less than five millimeters (preferably less than one to two millimeters) larger than the outer diameter of the semiconductor wafer 60.

The carrier head 10 and loaded semiconductor wafer 60 then are moved over a conventional semiconductor wafer polishing pad 62 which is mounted on a standard rotating platen 64, as shown in FIG. 1. The carrier head 10 then is lowered so that the wafer 60 contacts the surface of the polishing pad 62. Next, the valve for the vacuum source is closed and a pressurized fluid is introduced into the bore 39 of the spindle shaft 12. Although this fluid preferably is a gas, such as dry air or nitrogen which will not react with the surface of the semiconductor wafer 60, liquids such as deionized water may be utilized. The fluid flows from bore 39 through apertures 38 and 36 into the pattern of grooves 23–34 in the bottom surface 20 of the carrier plate 14, thereby filling the cavity 58 between the carrier plate 14 and the flexible wafer carrier membrane 46. This action inflates the cavity 58 expanding the bellows 54 of the wafer carrier membrane 46 and exerts pressure against the semiconductor wafer 60. The fluid may be pressurized to less than 15 psi (preferably between 0.5 psi and 10 psi) with the precise pressure depending upon the characteristics of the semiconductor wafer 60 and the abrasive material applied to the polishing pad 62. The pressure from the fluid is evenly distributed throughout the cavity 54 exerting an even downward force onto the semiconductor wafer 60.

Because the membrane 46 is very thin, it conforms to the top or backside surface of the semiconductor wafer 60. The membrane 46 is soft and highly flexible conforming to even the minute variations in the wafer surface. As a consequence, a carrier film is not required between the wafer 60 and the membrane 46 as the membrane 46 will conform to even minor surface contaminants on the backside of the semiconductor wafer 60.

During the polishing operation, the carrier head 10 is mechanically pressed downward so that the retaining ring 40 depresses the polishing pad 62. The lower edge 65 of the retaining ring 40 which contacts the polishing pad 62 is substantially co-planar with the semiconductor wafer surface being polished. This co-planar relationship and the very small (<5 mm) difference between the inner diameter of the retaining ring 40 and the outer diameter of the semiconductor wafer 60 significantly minimizes the edge abrasive effect encountered with prior polishing techniques. This abrasive effect was due to depression of the polishing pad 62 by the edge of the semiconductor wafer 60 as it rotated against the pad 62. As seen in FIG. 1, the retaining ring 40 of the present carrier assembly depresses the polishing pad 62 and because only a very small gap exists between the interior surface of the retaining ring 40 and the edge of the semiconductor wafer 60, the polishing pad 62 does not expand appreciably in that gap, thereby eliminating the severe edge abrasive effect previously encountered.

In addition, the present wafer carrier head 10 applies extremely uniform polish pressure across the entire area of the semiconductor wafer. The extreme flexibility and softness of the wafer carrier membrane 46 with the integral bellows 54 allows the carrier membrane 46 to respond to small disturbances on the face of the semiconductor wafer 60 which may be caused by some aspect of the polishing process such as pad variation, conditioning of the pad, and slurry flow rates. The flexible wafer carrier membrane 46 is thus able to automatically compensate for such variations and provide uniform pressure between the semiconductor wafer 60 and the polishing pad 62. Any energy associated with these disturbances is absorbed by the fluid in the cavity 58 behind the wafer carrier membrane 46 instead of increasing the local polishing rate of the semiconductor wafer 60.

Figure 4:
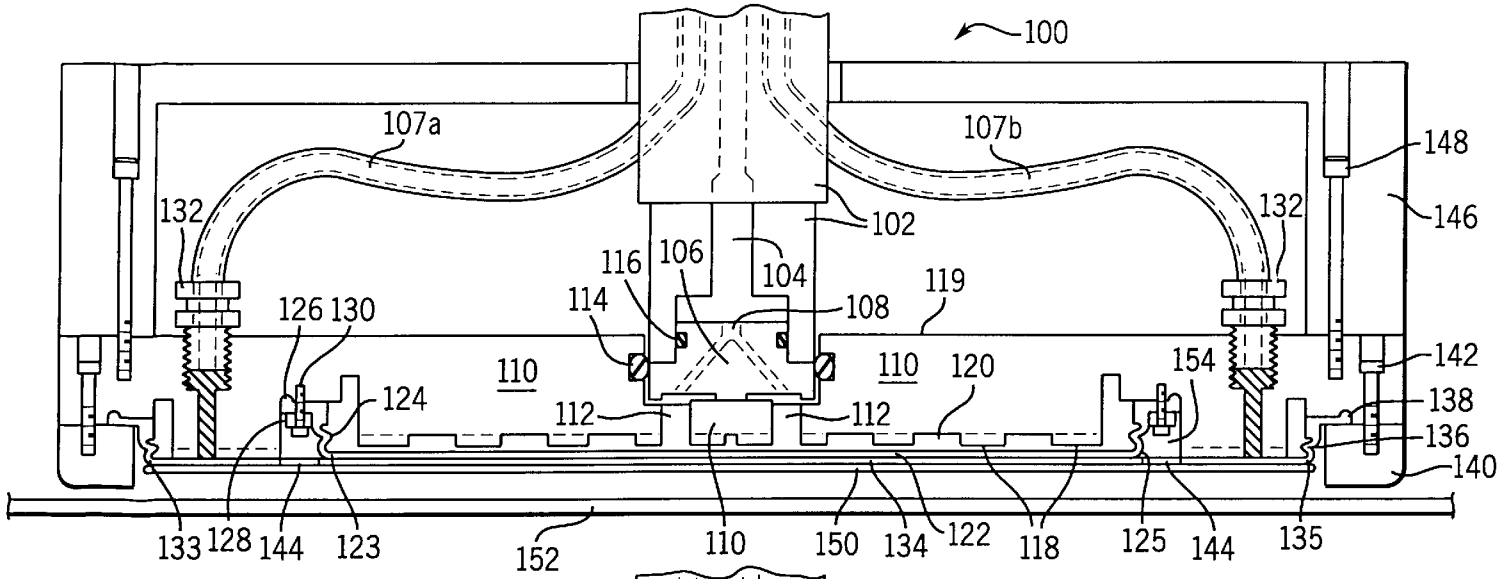
FIG. 4 is a diametric cross-sectional view through another embodiment of the wafer carrier of the present invention showing the carrier chucking a semiconductor wafer.
Figure 5:
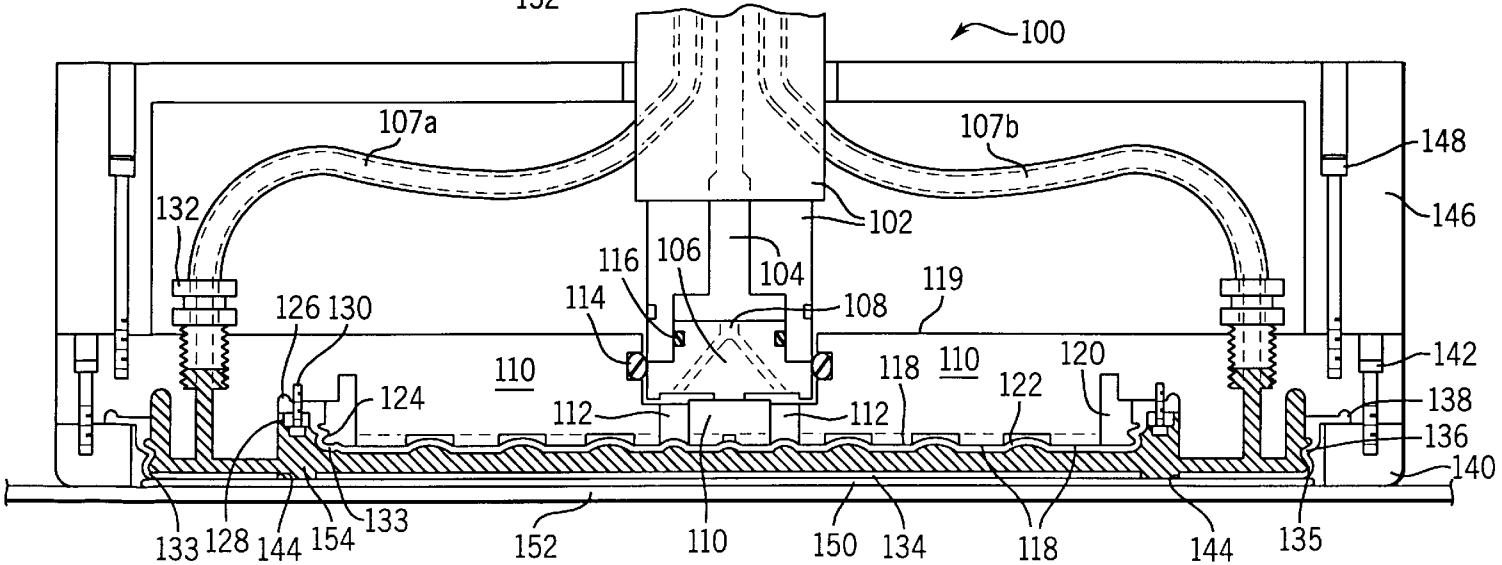
FIG. 5 is a diametric cross-sectional view of the wafer carrier of FIG. 4 showing pressurization of the cavity associated with the wafer carrier membrane.
Figure 6:
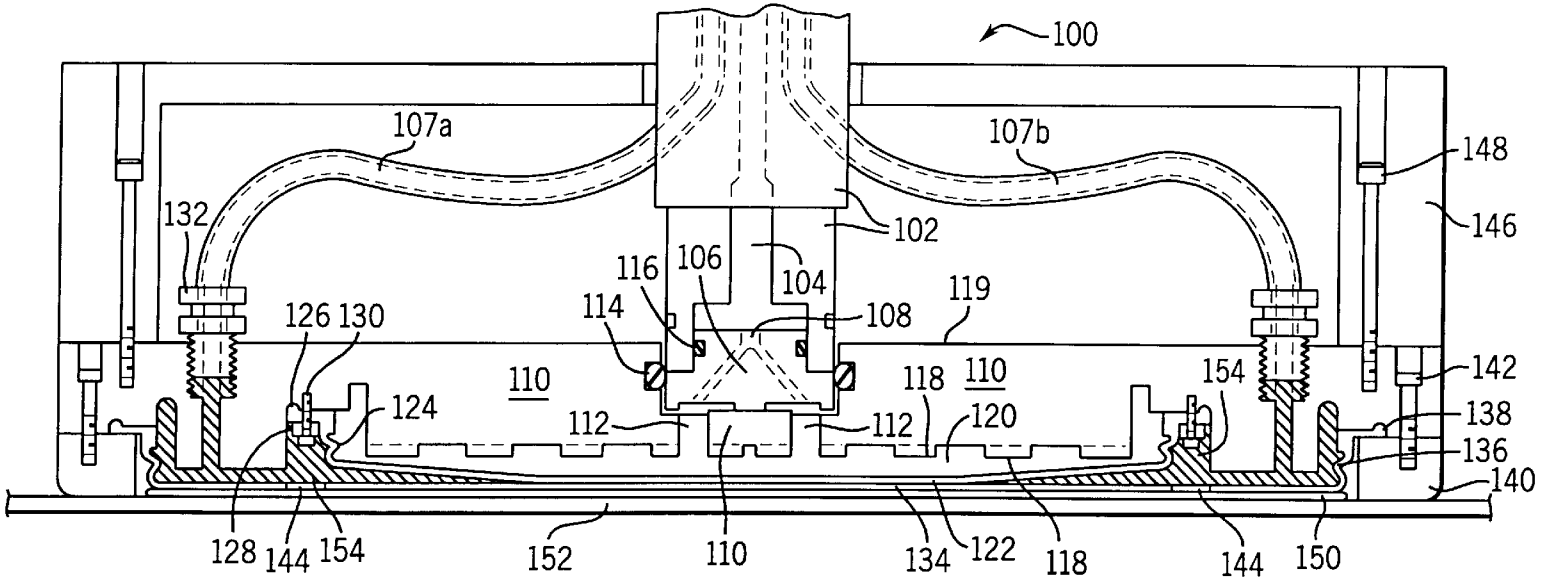
FIG. 6 is a diametric cross-sectional view of the wafer carrier of FIG. 4 showing pressurization of the cavities associated with both membranes.

Referring to FIGS. 4–6, a semiconductor wafer polishing apparatus has a carrier head 100 mounted on a spindle shaft 102 that is connected to a rotational drive mechanism by a gimbal assembly (not shown). The end of the spindle shaft 102 is fixedly attached to a rigid carrier plate 110 with a flexible sealing ring 114 therebetween to prevent fluid from leaking between the spindle shaft 102 and the carrier plate 110. Carrier plate 110 is preferably made of stainless steel, though alternative materials with rigid, sturdy characteristics may be used. Spindle shaft 102 may be attached to carrier plate 110 using a simple friction fit, or any other means for attachment well known to those skilled in the art. Additionally, spindle shaft 102 is preferably made from stainless steel, though it may be made with any suitable material. A button member 106 is provided between spindle shaft 102 and carrier plate 110. Button member 106 is preferably made of a plastic material; however, any appropriate material may be used for button member 106. An additional flexible sealing ring 116 is provided between button member 106 and spindle shaft 102. Carrier plate 110 has a planar upper surface 119 and a parallel lower surface 118.

Tubing 107*a* and 107*b* comprises a first conduit running from a first pressurizing source (not shown) to fasteners 132 connected to carrier plate 110. The first pressurizing source comprises any conventional system that provides regulated pressure or vacuum to fluid within tubing 107*a* and 107*b*. Another conduit comprises tubing 104, channels 108, and apertures 112. One end of tubing 104 is connected to a second pressurizing source (not shown) that comprises any conventional system providing a regulated pressure supply to fluid within tubing 104. The opposite end of tubing 104 is coupled to channels 108 within button member 106. In the preferred embodiment, there are four separate channels 108 in button member 106; however, only two channels 108 are shown in phantom in the figures, and a different number of channels 108 is permissible. Channels 108 intersect with apertures 112 in carrier plate 110 to complete the second conduit path. Tubing 107*a*, 107*b*, and 104 comprises any conventional, and preferably flexible, tubing for use in a pneumatic and/or hydraulic system. A cover 146 is connected to carrier plate 110 using fasteners 148. Cover 146 protects the internal components of the carrier 100 from external debris.

A wafer carrier membrane 134 is coupled to carrier plate 110 by clamping the flange 138 of membrane 134 between retaining member 140 and carrier plate 110. Retaining member 140 is connected to carrier plate 110 using fasteners 142. Wafer carrier membrane 134 includes a centrally located wafer contact section between positions 133 and 135 of wafer carrier membrane 134. Thus, the wafer contact section preferably comprises a circular-shaped portion centrally located in membrane 134. The wafer contact section includes a plurality of apertures 144 therethrough. Here, two apertures 144 are shown, but more or less could be used. Membrane 134 also includes a bellows 136 that is coupled between the membrane's flange 138 and the edge of the wafer contact section. A cavity 154 is bounded by wafer carrier member 134 and carrier plate 110. Wafer carrier membrane 134 is preferably formed of molded polyurethane, although a thin sheet of any of several soft, resilient materials may be utilized. Wafer carrier membrane 134 of FIGS. 4–8 is preferably substantially similar to wafer carrier membrane 46 of FIGS. 1–3. Accordingly, wafer carrier member 134 may also be made from multiple sheets of material connected into a single soft, resilient sheet.

An internal wafer carrier membrane 122 is coupled to carrier plate 110 by clamping a flange 126 of membrane 122 between a locking member 128 and carrier plate 110. Locking member 128 is connected to carrier plate 110 with connectors 130. A section of membrane 122 between positions 123 and 125 is for contacting the back or inner surface of the wafer contact section of wafer carrier member 134. This section of membrane 122 is preferably circular in shape and central to membrane 122. Membrane 122 also includes a bellows 124 located between the membrane's central section and flange 126. An additional cavity 120 is formed between internal wafer carrier membrane 122 and carrier plate 110. Cavity 120 is thus subsumed within cavity 154 formed by wafer carrier membrane 134. Internal wafer carrier membrane 122 is also preferably formed of molded polyurethane, however, a thin sheet of any of several soft, resilient materials may be utilized. Additionally, multiple sheets of material may be connected into a single soft, resilient sheet for internal wafer carrier membrane 122. A semiconductor wafer 150 is bounded by wafer carrier membrane 134, a polishing pad 152, and retaining member 140.

Figure 7:
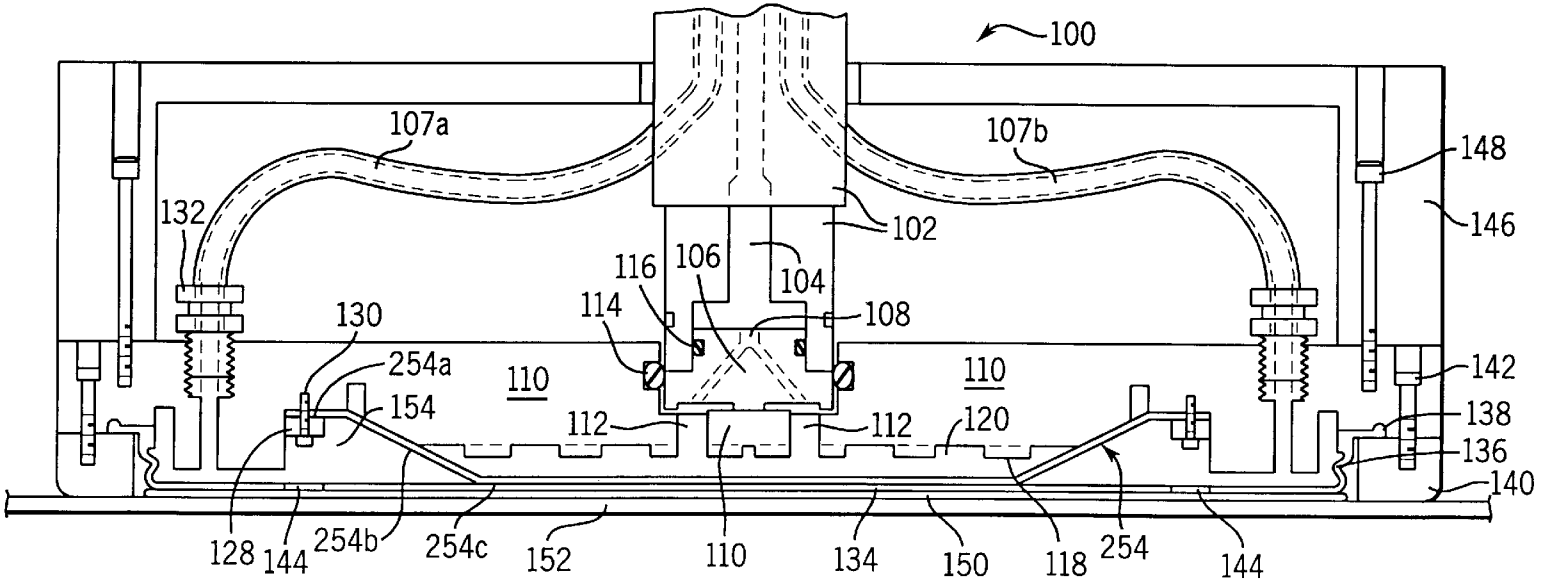
FIG. 7 is a diametric cross-sectional view of another embodiment of the wafer carrier of the present invention.
Figure 8:
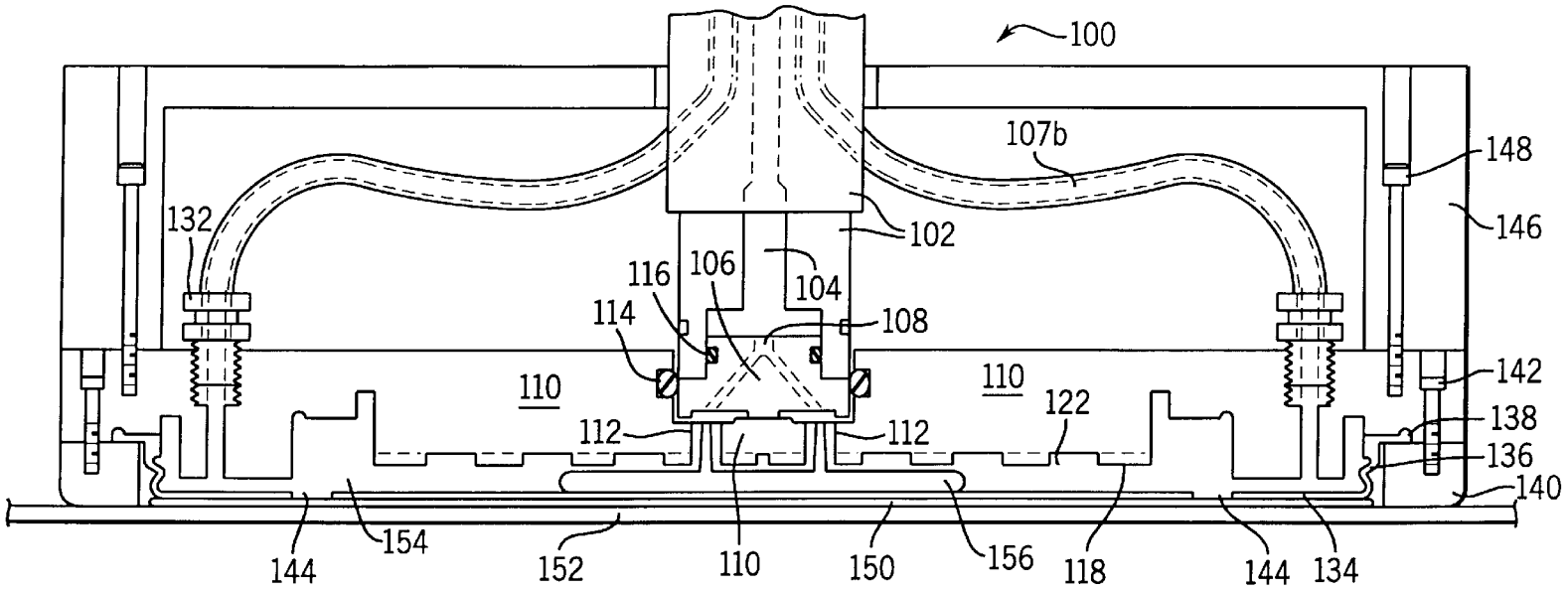
FIG. 8 is a diametric cross-sectional view of another embodiment of the wafer carrier of the present invention.

Referring to FIGS. 7 and 8, two different embodiments of the carrier head 100 are shown that are both similar to the embodiment of carrier head 100 shown in FIGS. 4–6. Referring to FIGS. 4 and 7, the internal wafer carrier membrane 122 of FIG. 4 has been replaced with an elastomer 254 in FIG. 7. Elastomer 254 does not have the bellows and flange arrangement of the internal wafer carrier membrane 122 from FIG. 4. Generally, elastomer 254 has a unique shape. Specifically, elastomer 254 has a peripheral section 254*a* substantially parallel with the wafer 150. Section 254*a* is clamped between locking member 128 and carrier plate 110. Moving inward from the perimeter of elastomer 254, a section 254*b* is tapered to slant downward with respect to section 254*a*. As elastomer section 254*b* approaches wafer carrier membrane 134, a section 254*c* is substantially parallel to section 254*a*. Additionally, section 254*c* substantially abuts an internal surface of wafer carrier membrane 134. Elastomer 254 is preferably made from molded polyurethane, but a thin sheet of any of several soft, resilient materials may be implemented. Similarly, multiple sheets of material may be connected into a single soft, resilient sheet for elastomer 254.

Referring to FIGS. 4 and 8, the internal wafer carrier membrane 122 of FIG. 4 has been replaced with a balloon-like membrane 156 in FIG. 8. Balloon-like membrane 156 may be connected to carrier plate 110 and/or the central conduit fed from tubing 104 using any conventional manner. Balloon-like membrane 156 is preferably made of a molded polyurethane, although a thin sheet of any of several soft, resilient materials may be utilized. Balloon-like membrane 156 could also be fabricated out of several soft, resiliant sheets of material bonded into a single sheet.

Figure 9B:
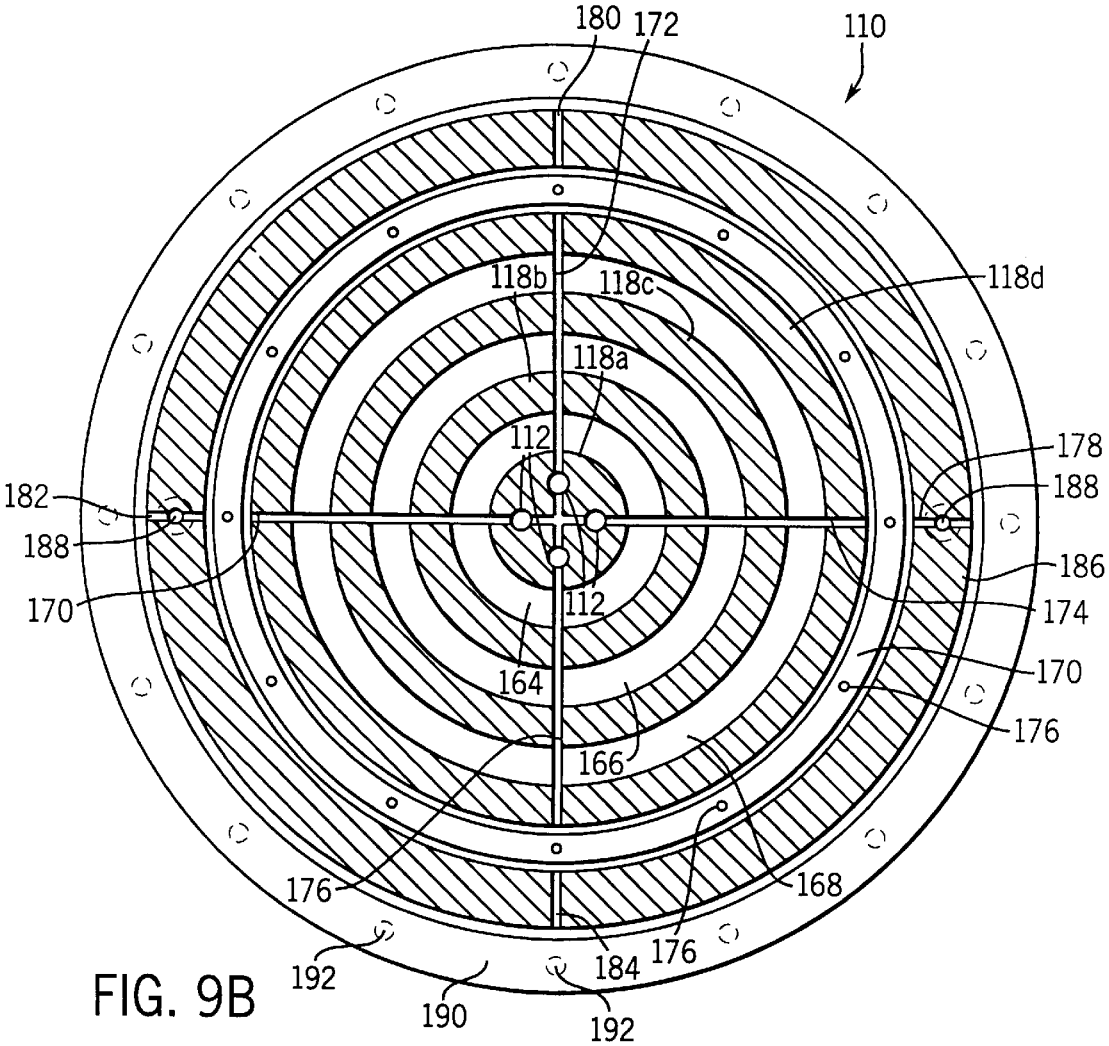
FIG. 9B is a bottom plan view of the carrier's rigid plate.
Figure 9A:
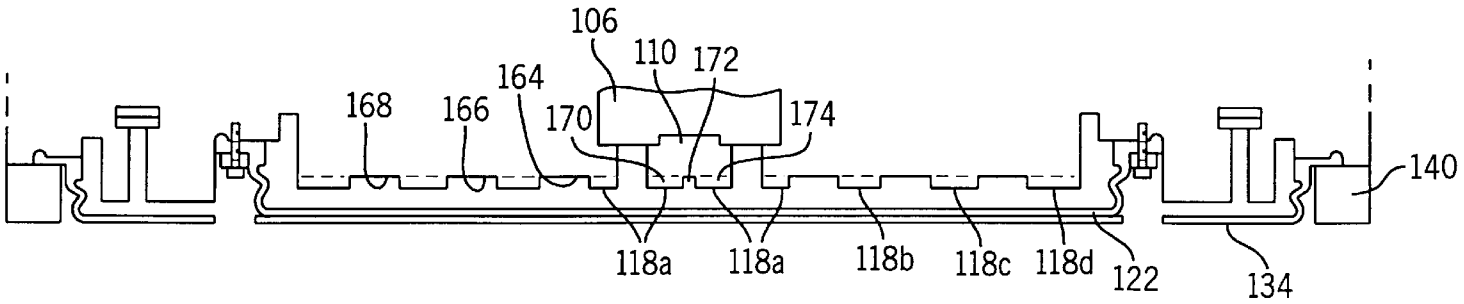
FIG. 9A is a diametric cross-sectional view showing a portion of the wafer carrier from FIG. 4.

Referring to FIG. 9B, a bottom plan view of the lower surface 118 of carrier plate 110 is shown. The diametric cross-sectional view of FIG. 9A aids in understanding the layout depicted in FIG. 9B. The lower surface 118 of the carrier plate 110 has a plurality of grooves therein. The lower surface 118 has a plurality of raised sections 118*a*, 118*b*, 118*c*, and 118*d*. Also included are three spaced apart concentric annular grooves 164, 166, and 168, in order of increasing diameter. Annular recess 170 surrounds raised section 118*d* of lower surface 118. Annular recess 170 includes a plurality of apertures 176 for connecting locking member 128 (see FIGS. 4–8). Raised surface 186 bounds annular recess 170. Raised surface 186 includes a plurality of apertures 188 that supply a source of pressure or a source of vacuum to cavity 154. Annular recess 190 forms the outermost section of carrier plate 110. Annular recess 190 includes a plurality of apertures 192 for receiving fasteners 142 for connecting retaining member 140. The central raised portion 118*a* of lower surface 118 includes a plurality of apertures 112 that are in fluid communication with tubing 104 (see FIG. 4–8). Axial grooves 170–176 run from the center of raised surface 118*a* to surface 118*d*. The depth of axial grooves 170–176 preferably exceeds the depth of annular grooves 164–168. Pressurized fluid supplied through tubing 104 and channels 108 is in fluid communication with apertures 112, which are also in fluid communication with axial grooves 170–176, and annular grooves 164–168, thereby permitting pressurization of cavity 120. Additional axial grooves 178–184 are shown in raised surface 186. Axial grooves 178–184 are not in fluid communication with axial grooves 170–176. Accordingly, pressurized fluid or vacuum supplied through tubing 107 and apertures 188 are in communication with cavity 154.

In order to process a semiconductor wafer 150, the carrier head 100 is moved over a wafer storage area and lowered onto a semiconductor wafer 150. The wafer 150 may also be loaded by a separate robotic wafer transfer arm. The spindle shaft 102 is connected to a vacuum source by a rotational coupling and valve (not shown). With the carrier head 100 positioned over the semiconductor wafer 150, the vacuum valve is opened to evacuate the cavity 154 formed between the carrier plate 110 and the wafer carrier membrane 134. This action draws air into cavity 154 through the small apertures 144 in wafer carrier membrane 134 and creates suction which draws semiconductor wafer 150 against wafer carrier membrane 134. This process is referred to by those skilled in the art as "chucking," and it is depicted in FIG. 4. Although evacuation of cavity 154 causes wafer carrier membrane 134 to be drawn against raised surface 186, the pattern of axial grooves 178–184 in surface 186 provides passageways for air to continue to be drawn through apertures 144 in membrane 134, thereby holding semiconductor wafer 150 against carrier head 100. Less effective chucking is established without use of axial grooves 178–184. It should be noted that the interior diameter of retaining member 140 is less than 5 millimeters (preferably less than 1 to 2 millimeters) larger than the outer diameter of the semiconductor wafer 150.

The carrier head 100 and chucked wafer 150 are then moved over a conventional semiconductor wafer polishing pad 152, which is mounted on a standard rotating platen (not shown). Carrier head 100 is then lowered so that the wafer 150 contacts the surface of the polishing pad 152. Next, the valve for the vacuum source is closed, and a pressurized fluid is introduced into tubing 107*a* and 107*b* in spindle shaft 102. Although this fluid preferably is a gas, such as dry air or nitrogen, which will not react with the surface of the semiconductor wafer 150, liquids such as deionized water may be utilized. The pressurized fluid flows through tubing 107*a* and 107*b*, through conduit fasteners 132, and into cavity 154. The pressurized fluid then creates a force against the interior surface of wafer carrier membrane 134 that causes bellows 136 to expand, thereby applying a downward force against semiconductor wafer 150, which is supported by polishing pad 152 and platen. The opposing force of the semiconductor wafer 150 against the wafer carrier membrane 134 seals apertures 144, and therefore, cavity 154. The pressure from the fluid is evenly distributed throughout cavity 154 exerting an even downward force onto semiconductor wafer 150. By adjusting the pressure supplied through tubing 107*a* and 107*b*, the substantially uniform and downward force applied against semiconductor wafer 150 by membrane 134 is controlled. The fluid may be pressurized to less than 15 psi (preferably between 0.5 psi and 10 psi) with the precise pressure depending upon the characteristics of the semiconductor wafer 150 and the abrasive material applied to the polishing pad 152.

Because the wafer carrier membrane 134 is very thin, it conforms to the top or backside surface of the semiconductor wafer 150. The membrane 134 is soft and highly flexible conforming to even the minute variations in the wafer surface. As a consequence, a carrier film is not required between the wafer 150 and the membrane 134, as the membrane 134 will conform to even minor surface contaminants on the backside of the semiconductor wafer 150.

Referring to FIG. 5, only the outer membrane (i.e., the wafer carrier membrane 134) is used to polish semiconductor wafer 150. The internal wafer carrier membrane 122 is not being used in FIG. 5. Additionally, each embodiment of the carrier head 100, as depicted in FIGS. 4–8, may operate in a state whereby only the outer membrane (i.e., the wafer carrier membrane 134) is used to polish the semiconductor wafer 150. When using only the outer membrane 134 to polish the semiconductor wafer 150, carrier head 100 operates substantially like carrier head 10 in FIGS. 1–3. However, each embodiment of carrier head 100, as depicted in FIGS. 4–8, includes an internal wafer carrier membrane that may be selectively used in order to correct the center slow removal problem.

Specifically and with reference to FIG. 6, pressurized fluid is introduced into tubing 104 which is in communication with channels 108, apertures 112, and cavity 120. As pressurized fluid is introduced into cavity 120, bellows 124 expand in a downward direction, thereby forcing at least part of the central section between positions 123 and 125 of the internal wafer carrier membrane 122 against the interior surface of the wafer carrier membrane 134. By controlling the pressure supplied through tubing 104 into cavity 120, one can control the magnitude of force applied by the internal wafer carrier membrane 122 against wafer carrier membrane 134. Thus, a region of localized, higher pressure may be applied in proximity to the central region of semiconductor wafer 150. Specifically, a portion of semiconductor wafer 150 located beneath a circular region having an approximate diameter equivalent to or less than the distance between positions 123 and 125 of the internal wafer carrier membrane 122 may be subjected to the elevated force.

FIG. 6 depicts cavities 120 and 154 being exposed to pressurized fluid through tubing 104 and 107, respectively. At least a portion of the internal wafer carrier membrane 122 is forced against wafer carrier membrane 134, thereby exerting a region of greater force against the semiconductor wafer 150 where the membranes 122 and 134 meet. The greater force applied where the membranes 122 and 134 meet facilitates greater removal rates underneath this region on the semiconductor wafer 150. By controlling the pressure of fluid introduced into cavity 120, one can control both the degree of contact between the membranes 122 and 134, as well as the magnitude of localized higher force applied against semiconductor wafer 150, thereby controlling the increased removal rate in the vicinity of the center of the semiconductor wafer 150.

Referring to FIG. 7, the wafer carrier membrane 134 is in forceable, downward contact with semiconductor wafer 150 due to pressurization of cavity 154. Similarly, elastomer 254 is in forceable, downward contact with wafer carrier membrane 134. Specifically, the abutting section 254*c* of elastomer 254 is in forceable, downward contact with wafer carrier membrane 134 due to the pressurization of cavity 120. By controlling the pressure within cavity 120, the removal rate of material underneath abutting section 254*c* on semiconductor 150 can be increased in a controlled manner, thereby correcting the center slow removal problem.

Referring to FIG. 8, the wafer carrier membrane 134 is in forceable, downward contact with semiconductor wafer 150 due to the pressurization of cavity 154. Similarly, the balloon-like membrane 156 is pressurized through tubing 104, thereby causing a portion of balloon-like membrane 156 to make forceable, downward contact against wafer carrier membrane 134. By choosing an appropriately sized balloon-like membrane 156, in combination with selecting an appropriate pressure to apply to balloon-like membrane 156, one can control the removal rate of semiconductor wafer 150 underneath the region where wafer carrier membrane 134 and balloon-like membrane 156 make contact.

These features of the present wafer carrier head 100 produce uniform or non-uniform polishing across the semiconductor wafer, as desired, to enable use of the entire wafer surface for circuit fabrication.

It should be understood that the apparatus described above are only exemplary and do not limit the scope of the invention, and that various modifications could be made by those skilled in the art that would fall under the scope of the invention. For example, more than one internal wafer carrier membrane could be used, and whether one or more internal wafer carrier membranes are used, it need not necessarily be centered with respect to the semiconductor wafer surface. Though described with the carrier above the platen, those skilled in the art could accomplish similar results with different orientations of these items.

Additionally, the terms "wafer" or "semiconductor wafer" have been used extensively herein; however, they may be more generally referred to by the term, "workpiece," which is intended to include the following: semiconductor wafers, both bare silicon or other semiconductor substrates such as those with or without active devices or circuitry, and partially processed wafers, as well as silicon on insulator, hybrid assemblies, flat panel displays, Micro Electro- Mechanical Sensors (MEMS), MEMS wafers, hard computer disks or other such materials that would benefit from planarization. Additionally, the term "polishing rate" is intended to mean a material removal rate of anywhere between 100 Angstroms per minute to 1 micron per minute.

To apprise the public of the scope of this invention, the following claims are provided:

What is claimed is:

1. A carrier for an apparatus which performs chemical-mechanical planarization of a surface of a workpiece, wherein the carrier comprises:

a rigid plate having a major surface;

a wafer carrier membrane of soft, flexible material with a wafer contact section having an outer surface and an inner surface wherein the outer surface is for contacting an opposite surface of the workpiece, the wafer carrier membrane connected to the rigid plate and extending across at least a portion of the major surface thereby defining a first cavity therebetween;

an internal wafer carrier membrane with a section having an outer surface for contacting the inner surface of the wafer contact section, the internal wafer carrier membrane connected to the rigid plate and extending across at least a portion of the major surface thereby defining a second cavity therebetween;

a first fluid conduit by which a source of pressurized fluid is connected to the first cavity; and a second fluid conduit by which a source of pressurized fluid is connected to the second cavity.

2. The carrier as recited in claim 1 further including a retaining member secured to the rigid plate around the wafer contact section of the wafer carrier membrane.

3. The carrier as recited in claim 1 wherein the wafer carrier membrane has a plurality of apertures through the wafer contact section.

4. The carrier as recited in claim 1 wherein the wafer carrier membrane in the wafer contact section has a substantially uniform thickness.

5. The carrier as recited in claim 1 wherein circumference of the wafer contact section of the wafer carrier membrane is coupled to a bellows which is coupled to the rigid plate.

6. The carrier as recited in claim 5 wherein the wafer carrier membrane further comprises a flange extending around the bellows and abutting the rigid plate.

7. The carrier as recited in claim 2 wherein the wafer carrier membrane further includes a bellows having a first end attached to the wafer contact section and having a second end, and a flange projecting from the second end and sandwiched between the major surface of the rigid plate and the retaining member.

8. The carrier as recited in claim 1 wherein the rigid plate has a plurality of channels on the major surface and the fluid conduits communicate with the plurality of channels.

9. The carrier as recited in claim 1 wherein the rigid plate has a plurality of concentric annular channels on the major surface.

10. The carrier as recited in claim 9 wherein the rigid plate further includes axial grooves interconnecting the plurality of concentric annular channels.

11. The carrier as recited in claim 1 wherein the internal wafer carrier membrane comprises a soft, flexible material.

12. The carrier as recited in claim 2 wherein the workpiece has a perimeter, and the retaining member has a perimeter which is less than five millimeters larger than the perimeter of the workpiece.

13. The carrier as recited in claim 2 wherein the retaining member has a surface which is substantially coplanar with the surface of the workpiece undergoing chemical-mechanical planarization.

14. The carrier as recited in claim 1 further comprising a fluid within the cavities, wherein the fluid is selected from the group consisting of air, nitrogen and water.

15. The carrier as recited in claim 1 wherein circumference of said section of the internal wafer carrier membrane is coupled to a bellows which is coupled to the rigid plate.

16. The carrier as recited in claim 15 wherein the internal wafer carrier membrane further comprises a flange extending around the bellows and abutting the rigid plate.

17. The carrier as recited in claim 1 wherein the internal wafer carrier membrane further includes a bellows having a first end attached to said section of the internal wafer carrier membrane and having a second end, and a flange projecting from the second end and sandwiched between the major surface and a locking member.

18. The carrier as recited in claim 1 wherein the wafer carrier membrane and the internal wafer carrier membrane are connected to each other.

19. The carrier as recited in claim 1 wherein an area of the section for contacting the wafer contact section is less than an area corresponding to the wafer contact section.

20. The carrier as recited in claim 1 wherein the second cavity is within the first cavity.

21. A carrier for an apparatus which performs chemical-mechanical planarization of a surface of a workpiece, wherein the carrier comprises:

a rigid plate having a major surface;

a wafer carrier membrane of soft, flexible material with a wafer contact section having an outer surface and an inner surface wherein the outer surface is for contacting an opposite surface of the workpiece, the wafer carrier membrane connected to the rigid plate and extending across at least a portion of the major surface thereby defining a first cavity therebetween;

an internal wafer carrier membrane comprising a balloon-like portion with a section for contacting the inner surface of the wafer contact section;

a first fluid conduit by which a source of pressurized fluid is connected to the first cavity; and a second fluid conduit by which a source of pressurized fluid is connected to a second cavity formed by the balloon-like portion.

22. A method of operating a carrier for an apparatus which performs chemical-mechanical planarization of a surface of a workpiece comprising the steps of:

providing a rigid plate having a major surface;

pressurizing a first cavity formed between a wafer carrier membrane of soft, flexible material and the major surface such that an outer surface of wafer contact section of the wafer carrier membrane contacts an opposite surface of the workpiece; and pressurizing a second cavity formed between an internal wafer carrier membrane of soft, flexible material and the major surface such that an outer surface of a section of the internal wafer carrier membrane makes contact with an inner surface of the wafer carrier membrane.

23. A method of operating a carrier for an apparatus which performs chemical-mechanical planarization of a surface of a workpiece comprising the steps of:

positioning the carrier including a membrane with at least one aperture therethrough over a surface of the workpiece;

applying vacuum through each aperture to chuck the workpiece against the membrane;

moving the carrier and chucked workpiece into position against a polishing surface;

releasing vacuum through each aperture; and applying pressurized fluid into a cavity located between a surface of the carrier and the membrane.

* * * * *